United States Patent [19]

Ryan

[11] Patent Number: 4,579,814

[45] Date of Patent: Apr. 1, 1986

[54] SULFONATED LITHIUM CATION EXCHANGED POLYSTYRENE PHOTOGRAPHIC FILMS

[75] Inventor: Kevin J. Ryan, Granville, Ohio

[73] Assignee: The Dow Chemical Company, Midland, Mich.

[21] Appl. No.: 678,516

[22] Filed: Dec. 5, 1984

[51] Int. Cl.[4] ..... G03C 1/82

[52] U.S. Cl. ..... 430/536; 156/308.8; 156/309.3; 427/40; 427/44; 427/54.1; 430/531

[58] Field of Search ..... 430/536, 531, 532; 427/44, 40, 54.1; 156/308.8, 309.3

[56] References Cited

U.S. PATENT DOCUMENTS

| | | | |
|---|---|---|---|
| 2,816,027 | 12/1957 | Farrell et al. | 430/536 |
| 2,872,318 | 2/1959 | Starck . | |
| 3,112,199 | 11/1963 | Camerini et al. | 430/536 |
| 3,597,208 | 8/1971 | Nishio et al. | 430/536 |
| 3,630,742 | 12/1971 | Crawford et al. | 430/536 |
| 3,725,109 | 4/1973 | Schulz et al. . | |

FOREIGN PATENT DOCUMENTS

| | | |
|---|---|---|
| 674921 | 11/1963 | Canada . |
| 1100712 | 2/1968 | United Kingdom . |

*Primary Examiner*—Jack P. Brammer
*Attorney, Agent, or Firm*—Douglas N. Deline

[57] ABSTRACT

Photographic films comprising a base film of oriented polystyrene at least one surface of which is highly sulfonated and lithium cation exchanged.

6 Claims, No Drawings

SULFONATED LITHIUM CATION EXCHANGED POLYSTYRENE PHOTOGRAPHIC FILMS

BACKGROUND OF THE INVENTION

This invention relates to styrene polymer photographic films and a method for making them.

It is known from Canadian Pat. No. 674,921 that photographic films can be prepared from a polystyrene film base if an acrylic copolymer anchoring layer and a gelatin subbing layer are added to the film base before a photographic gelatin emulsion is added. The patent to Starck, U.S. Pat. No. 2,872,318, suggests that the above anchoring layer can be eliminated if a subbing layer is applied from a special mixture of solvents.

Photographic films prepared by these processes are expensive because of the multiplicity of steps involved in their manufacture.

The use of other film bases for photographic purposes has been suggested by U.S. Pat. No. 2,805,173 wherein polyethylene terephthalate is used and U.S. Pat. No. 3,112,199 wherein isotactic polypropylene is used. These patents show that anchoring layers and subbing layers can be eliminated if the polymer surface is treated with a solution of chlorosulfonic acid and then aminated with various amines before a photographic gelatin emulsion is applied. Photographic films prepared by the teachings of U.S. Pat. No. 2,805,173 are expensive due to the high cost of the polymer base. Photographic films prepared by the teachings of U.S. Pat. No. 3,112,199 lack the required stiffness for normal film processing and handling.

When attempts are made to sulfonate polypropylene and polyethylene terephthalate films to a high degree of sulfonation which is necessary for good adhesion, it is found that the film surface turns dark brown or black in the case of polypropylene and crumples away to a powder in the case of polyethylene terephthalate.

In U.S. Pat. No. 3,725,109 a method is claimed for producing a photographic film from biaxially oriented films of styrene polymers by sulfonating them with a sulfur containing compound to produce a film having a high degree of sulfonic acid groups on the surface of the film. It has now been discovered that the quality of photographic film produced according to the process of U.S. Pat. No. 3,725,109 may vary depending on the composition of the photographic gelatin emulsion employed.

A process for sulfonating the surface of polystyrene and exchanging the hydrogen ions in the sulfonated groups with metal ions is disclosed in British Pat. No. 1,100,712.

SUMMARY OF THE INVENTION

The present invention concerns a method for improving the adhesion of photographic gelatin emulsion to film formed from styrene polymer resins by sulfonating the film and exchanging lithium ions for the hydrogen ions of the sulfonate groups. More particularly, it now has been found that photographic films can be produced from biaxially oriented films of styrene polymer resins by sulfonation to provide sufficient sulfonic acid groups on the surface to improve the adhesion of a photographic gelatin emulsion thereto and replacing at least some of the hydrogen ions on the sulfonic acid groups with lithium cations. By this process, the adhesion of the photographic gelatin emulsion to the film is increased over the degree of adhesion obtained by the sulfonation treatment only. The subsequent application of a photographic gelatin emulsion layer results in a photographic film that is economical to make, has good dimensional stability during photographic processing and has good adhesion between the base and the gelatin layer. Additionally, the present invented composition accumulates markedly reduced amounts of static electricity thereby minimizing contamination due to accumulation of dust particles.

DETAILED DESCRIPTION

The polymer films to which this invention is directed are those known to the art and comprise those oriented films formed from styrene polymer resins. Non-oriented styrene polymer films lack the structural strength which is necessary in photographic film applications.

Suitable films include those composed of styrene polymer resins and blends thereof with other resins and components which are employed to prepare films having specific physical characteristics desired in photographic film applications.

The term "styrene polymer resin" refers to polystyrene, copolymers of styrene with one or more copolymerizable ethylenically unsaturated monomers, or blends or grafts of polystyrene with synthetic elastomeric polymers. The term "styrene" is used to denote not only styrene but also alkyl-substituted derivatives of styrene such as $\alpha$-methyl styrene. Examples of suitable styrene polymer resins are polystyrene, high impact polystyrene, acrylonitrile styrene copolymers, acrylonitrile butadiene styrene resins, methyl methacrylate-styrene copolymers, poly-$\alpha$-methylstyrene, or copolymers of styrene and $\alpha$-methylstyrene.

The term "ethylene polymer resin" refers to polyethylene or copolymers of ethylene with one or more copolymerizable ethylenically unsaturated monomer. Suitable ethylene polymer resins include high density polyethylene, medium density polyethylene, low density polyethylene, chlorinated polyethylene, ethylene-higher alkene copolymers, ethylene-vinyl acetate copolymers, ethylene-vinyl chloride copolymers, ethylene-ethyl acrylate copolymers, and ethylene-acrylic acid copolymers and ionomers.

Mixtures of styrene polymer resins as well as mixtures of ethylene polymer resins can be used.

A specific film which finds good utility for photographic films comprises a blend of styrene polymer resin, an ethylene polymer resin and an inorganic filler. Films of the type are taught, for example, in British Pat. No. 1,257,512 and U.S. Pat. No. 3,993,718, the teachings of which are specifically incorporated herein by reference. Preferably, the inorganic filler is titanium dioxide, and the blend contains greater than about 50 percent by weight of styrene polymer resin. More preferably, the blend also contains an elastomer polymer compound such as polybutadiene, a styrene-butadiene rubber, or an acrylonitrile-butadiene rubber to improve physical properties of the film.

A more preferred film comprises from about 78 to about 88 weight percent styrene polymer resin, from about 3 to about 6 weight percent ethylene polymer resin, from about 3 to about 6 weight percent of an elastomer compound, and from about 6 to about 10 weight percent titanium dioxide. Most preferably, such blend is prepared from styrene homopolymer or thermoplastic styrene-butadiene copolymer (high impact polystyrene), ethylene homopolymer and an elastomeric styrene-butadiene star block copolymer compatibilizer and titanium dioxide. The individual blend components and the overall blend can also include other additives which are normally incorporated into resin blends such as stabilizers, anti-static agents, plasticizers, colorants, and anti-oxidants.

As is well known from the literature (e.g., "Encyclopedia of Polymer Science," vol. 2, pages 339–373) biaxial orientation increases the tensile strength of polymer films in general and for polystyrene film it raises the range of ultimate tensile strength to about 3,500 to about 12,000 pounds per square inch in both the machine direction and the transverse direction.

Therefore, the films used in this invention are oriented styrene polymer resin films having a tensile strength in the range of from about 3,500 to about 12,000 psi with or without impact strength modifiers of the type set forth above.

These oriented styrene polymer films are sulfonated on at least one side to produce sulfonic acid groups directly attached to the polymer film. Preferably, a high concentration of sulfonic acid groups are directly attached to the polymer film. Next the sulfonic acid groups may be neutralized with a lithium cation. When these films are coated with a photosensitive gelatin or emulsion layer on the metal ion neutralized sulfonated side of the film, the result is a photographic film of good durability with good adhesion of the gelatin to the base film and additionally, demonstrating reduced static charge build up.

If desired, the polymer film can be sulfonated and lithium ion neutralized on both sides. Subsequently, both sides of the film may be coated with gelatin or emulsion layers. For example, one surface may be coated with one or more photosensitive gelatin layers and the back side of the film may be coated with an anti-halation or other gelatin layer.

For the purposes of this invention, the term "high concentration of sulfonic acid groups" means a range from about 0.4 to about 13 micrograms of sulfur trioxide equivalents per square centimeter of film. A most preferred range is from about 5 to about 10 micrograms of sulfur trioxide equivalents per square centimeter.

The above films are sulfonated in any suitable manner. For example, films are vapor phase sulfonated with sulfur trioxide gas in a pure or dilute form to produce films having a high concentration of sulfonic acid groups directly attached to the styrene polymer. It is preferred to sulfonate the films by moving them through a blast or curtain of sulfur trioxide gas in the absence of water or water vapor as this technique provides a method with great speed, uniformity, and no complications such as removal of solvents, etc. Alternatively, films are passed through an atmosphere (versus a blast or stream of gas) of gaseous sulfur trioxide. In this technique slower speeds may be necessary to give adequate contact time between the film and the gas.

The sulfur trioxide gas can be used pure but since sulfur trioxide boils at 44.8° C. it is difficult to keep it in the vapor state. The preferred method is to dilute vapors of sulfur trioxide with a dry inert gas such as air, carbon dioxide, nitrogen and the like. The $SO_3$, in the inert gas, can range from about 1–15 percent by weight.

Another method of sulfonating the styrene polymer films is to treat them with a solution of $SO_3$ dissolved in an inert liquid solvent. Typical useful inert liquid solvents are hydrocarbon solvents such as hexane, heptane, petroleum ether, kerosene, etc. One technique for accomplishing this is taught, for example, in British Pat. No. 1,100,712.

The $SO_3$ in the above solvents can range from about 1 to about 25 percent by weight $SO_3$ but it is preferred to use a lower range of from about 1 to about 5 percent by weight $SO_3$.

In the foregoing sulfonation processes the temperature can range from about −20° C. to about 60° C. with the preferred temperature range being about 20° C. to about 40° C.

The pressure at which the sulfonation is carried out can be atmospheric, superatmospheric, or subatmospheric. Because of the convenience, it is preferred to carry out the sulfonation at atmospheric pressure or at slightly elevated pressures of about 1 to about 10 pounds per square inch gauge.

After the film is sulfonated to the desired degree it is brought into contact with a lithium cation source and at least some and preferably substantially all the hydrogen ions on the sulfonic acid groups are replaced with lithium cations.

In order to cause ion exchange to occur, the sulfonated film is merely dipped into or otherwise brought into contact with a source of lithium ions such as a lithium metal salt solution. Suitable salts include LiCl, $LiNO_3$, $Li_2SO_4$, etc., as well as any other source of lithium ions. Sufficient lithium cations should be provided to replace the desired amount of hydrogen ions contained on sulfonic acid groups present on the film. British Pat. No. 1,100,712 teaches a method for performing the ion exchange treatment. Enough lithium ions are exchanged to result in improved adhesion of the gelatin layers. Preferably, from about 10 percent to about 100 percent of the surface sulfonate groups are exchanged with lithium cations.

In some instances, sulfonated films may first be treated with ammonia to replace the hydrogen atoms on the sulfonic acid groups. The ammonium cations can be replaced with a lithium cation in the same manner as employed for the hydrogen atom resulting in an ultimate product wherein hydrogen ions are replaced by lithium cations.

As an alternative procedure for ion exchange, the lithium cations may be contained in a gelatin or emulsion, such as a photosensitive gelatin and ion exchange allowed to occur when the gelatin is applied to the sulfonated film.

After ion exchange treatment, the film may be coated with any one of a number of commercially available photographic gelatin emulsions and dried. These gelatins include the photosensitive gelatins and other photographic gelatin emulsions employed as adhesive materials and the like. The film in the form of a roll can be unwound and dipped into the gelatin one or more times in order to build up a photosensitive layer of suitable thickness. The complete film is then allowed to dry for a sufficient period of time to allow the gelatin layer to harden.

The prepared photographic films have antistatic properties and have good wet and dry adhesion between the photosensitive gelatin and the film base as indicated by a pressure sensitive tape test.

EXAMPLES

In the following examples a sulfonated film is prepared which includes neutralization with ammonia. The ammonia neutralized sulfonated film is then treated with a 0.1 N aqueous solution of a metal compound to exchange the ammonium cation with the metal cation.

The relative adhesion of a photosensitive gelatin layer to the film is measured by a wet adhesion test. In the test, the film is treated with a photosensitive gelatin composed of water, gelatin, methanol, formaldehyde and saponin. The film is passed through developing chemicals as in normal photographic processing. A grid is then scribed with a four prong fork through the gelatin to expose the polystyrene substrate. A cork or rubber eraser is then pressed and rubbed across the grid. The degree of adhesion is rated by the relative amount of gelatin removed from the film. The ratings range from 1 through 5 with a rating of 1 indicating essentially no gelatin loss and a rating of 5 indicating a loss of from about 26 to about 100 percent of the emulsion is removed.

The base film employed in the test is Trycite=brand biaxially oriented surface sulfonated polystyrene film available from The Dow Chemical Company. Films to be ion exchanged are contacted with a 0.1 N salt solution for one hour, rinsed with deionized water, dried for about 16 hours at ambient temperature, and coated with the gelatin layer (8 mil). Results of the above-described test are contained in Table I.

TABLE I

| Ion Exchange | Compound | Result |
|---|---|---|
| LiCl | | 1 |
| $NH_4SO_3$ | (comparative) | 4 |
| NaCl | " | 5 |
| NaOH | " | 5 |
| $CaCl_2$ | " | 5,3 |
| $FeCl_3$ | " | 5 |

TABLE I-continued

| Ion Exchange | Compound | Result |
|---|---|---|
| KOH | " | 5 |
| $BaCl_2$ | " | 5 |
| MgO | " | 5 |

What is claimed is:

1. An article comprising (1) an oriented styrene polymer film having at least one surface thereof sulfonated and at least some of the sulfonate groups of said surface neutralized by lithium cation exchange, and (2) a photosensitive gelatin layer adhered to said surface; provided that the amount of sulfonate groups present on the surface and neutralized is sufficient to provide improved adhesion of the gelatin layer compared to the adhesion of such layer to unneutralized sulfonated oriented styrene polymer film.

2. An article according to claim 1 wherein substantially all of the sulfonate groups of said surface are neutralized.

3. An article according to claim 1 wherein the sulfonate groups of said surface are first neutralized by contact with ammonium ions and the ammonium ions then exchanged with lithium cations.

4. An article according to claim 1 wherein the sulfonate groups are neutralized by exchange with a lithium cation prior to application of the photosensitive gelatin layer.

5. An article according to claim 1 wherein on two surfaces sulfonate groups have been neutralized by exchange with a lithium cation.

6. An article according to claim 1 wherein the amount of sulfonate groups present on the film surface is sufficient to provide from about 0.4 to about 13 micrograms of sulfur trioxide per square centimeter of film.

* * * * *